United States Patent [19]

Mueller

[11] Patent Number: 4,721,471

[45] Date of Patent: Jan. 26, 1988

[54] POWER BUS SYSTEM FOR PRINTED CIRCUIT BOARDS

[75] Inventor: Arthur L. Mueller, West Chester, Pa.

[73] Assignee: AMP Incorporated, Harrisburg, Pa.

[21] Appl. No.: 900,969

[22] Filed: Jul. 31, 1986

[51] Int. Cl.[4] ..... H01R 9/09

[52] U.S. Cl. ..... 439/78; 439/881

[58] Field of Search ..... 339/17 R, 17 C, 17 LC, 339/276 R, 276 T, 276 F; 174/88 C; 439/78–84, 881

[56] References Cited

U.S. PATENT DOCUMENTS

| | | | |
|---|---|---|---|
| 3,123,664 | 3/1964 | Logan | 174/84 C |
| 3,496,523 | 2/1970 | Gluntz | 339/17 LC |
| 3,708,641 | 1/1973 | Rubinstein | 339/276 F |
| 4,129,349 | 12/1978 | von Roesgen | 339/17 C |
| 4,618,209 | 10/1986 | Sonobe | 339/17 C |

FOREIGN PATENT DOCUMENTS

| | | | |
|---|---|---|---|
| 729313 | 3/1966 | Canada | 339/17 R |
| 54377 | 6/1982 | European Pat. Off. | 339/17 R |
| 266177 | 7/1964 | Netherlands | 339/17 C |

OTHER PUBLICATIONS

Electri-Onics Magazine, Bus Bars for PCB Applications Keyed to Design Performance, p. 23, 6-1984.

*Primary Examiner*—Neil Abrams

*Attorney, Agent, or Firm*—Allan B. Osborne

[57] ABSTRACT

A flexible power bus system for use in bringing to and distributing power on a printed circuit board. More particularly, the system includes electrical contact elements having a wire receiving ferrule at one end of a plate for being crimped onto a electrical wire and pins extending outwardly from another end of the plate for electrical engagement with power traces on the printed circuit board.

2 Claims, 13 Drawing Figures

POWER BUS SYSTEM FOR PRINTED CIRCUIT BOARDS

FIELD OF THE INVENTION

The present invention relates to devices used to conduct electrical power to various locations on a printed circuit board or backplane.

BACKGROUND OF THE INVENTION

Prior art power bus systems used in distributing current i.e., power, to a circuit board include rigid bus bars having outwardly extending pins for insertion into preselected holes in the circuit board. Such bars may be either vertical or horizontal; i.e., the plane of a vertical bar is normal to the plane of the circuit board while the plane of the horizontal bar is parallel to the board. While early type bus bars were straight, bus bars ar enow being made to follow a predetermined pattern on the board which may not be necessarily straight.

Whereas the above described bus bars are acceptable in the industry from a functional standpoint, the rigidity thereof limits the use to a particular pattern on a given circuit board and thus prohibits flexibility. That is, either the bus bar or the circuit board must be tailor-made for the other.

It is now proposed to provide a power bus system which is flexible and can be used on any board and further, can be taken off one board and placed on another even though the power circuit pattern on the second board differs from that on the first board.

SUMMARY OF THE INVENTION

According to the present invention, a power bus system is provided for use with a flexible electrical wire in transmitting and distributing power, to a printed circuit board. Electrical contact elements are disclosed which include a wire receiving ferrule at one end of a plate for being crimped around the wire at locations predetermined by the particular circuit board and outwardly extending pins spaced along the edge of the opposite end of the plate for being electrically connected to power circuits on the board. The system further includes insulative housings which slip over the contact elements to prevent accidental short circuiting.

DESCRIPTION OF THE INVENTION

Figure 1:
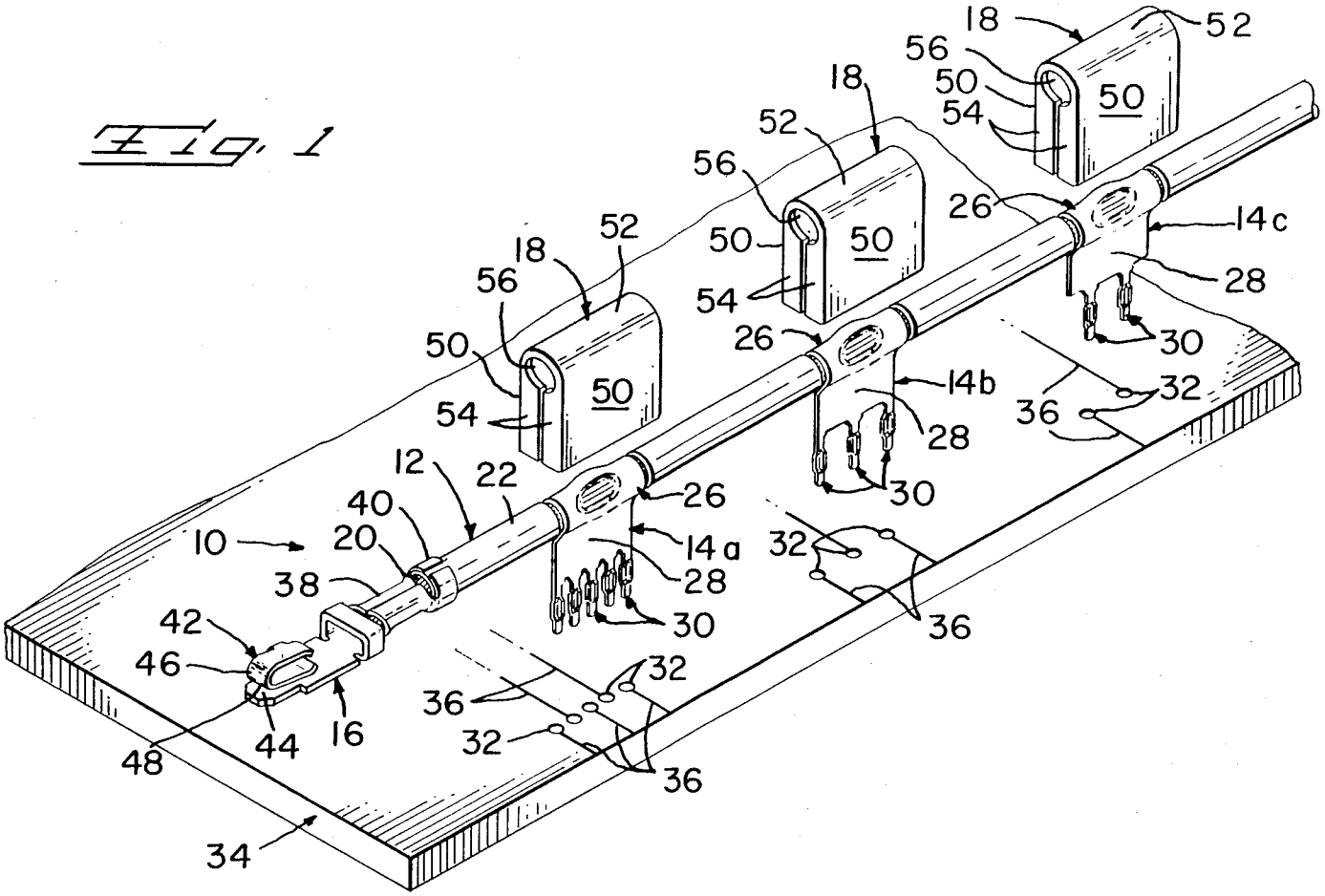
FIG. 1 is a perspective view of the power bus system of the present invention.

As shown in FIG. 1, power bus system 10 of the present invention includes insulated wire 12, one or more electrical contact elements 14, terminal 16, and protective, dielectric housings 18 for contact elements 14.

Wire 12 which is attached at one end to a power source (not shown), includes a multiple stranded conductor 20 and insulation jacket 22. Its gauge depends upon the required power; e.g., for a board requiring thirty amps, the gauge of wire 12 would be either twelve or ten. Wire 12 is a conventional item and is available from a large number and variety of manufacturers and vendors.

Electrical contact elements 14 include conductor ferrule 26, extending outwardly from one end of plate 28, and pins 30 extending outwardly from an opposite end of plate 28. As shown, ferrule 26 is crimped onto conductor 20 of wire 12 for electrical connection therewith and pins 30 are received in plated-through holes 32 in circuit boards 34 for electrical engagement with power traces 36 thereon. As will be observed, the three elements 14 shown include element **14*a* having five pins 30, element 14*b* having three pins 30 and element 14*c* having two pins 30. This and other aspects of contact elements 14 will be more fully discussed with reference to FIGS. 2–5**.

Terminal 16, crimped to one end of wire 12, includes conductor ferrule 38, insulation ferrule 40 and a hermaphroditic mating end 42. As shown, ferrule 38 is crimped onto conductor 20 at an end of wire 12 and ferrule 40 is crimped over insulation jacket 22 to prevent harmful flexing of wire 12 at the termination point.

Hermaphroditic mating end 42 includes tab 44 and U-shaped spring 46 attached to one side of and overlying tab 44 to define therebetween receptacle 48 which receives a tab 44 on another like terminal 16.

U-shaped protective housing 18 is molded from a suitable dielectric material such as nylon and includes parallel skirts 50 attached to bight 52 and inwardly directed flaps 54 attached to each end of each skirt 50. Opening 56 is provided at each end of housing 18 adjacent bight 52.

Figure 2:
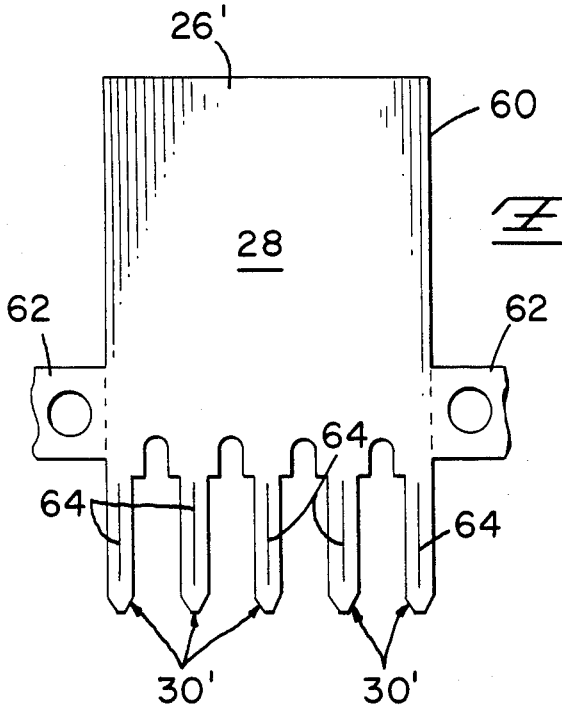
FIG. 2 is a plan view of a stamped but not formed electrical contact element of the power bus system.

FIG. 2 shows a contact element blank 60 after being stamped from a suitable conductive material such as phosphor bronze. The most economical method of manufacture is by stamping and forming in a continuous strip with adjacent blanks 60 being attached by carrier strips 62.

Blank 60 includes plate 28 with pre-formed pins 30' equally spaced along one end of plate 28 and preformed ferrule 26' at the opposite end. Pins 30' are split or sheared along a length thereof to define shear plane 64.

Figure 3:
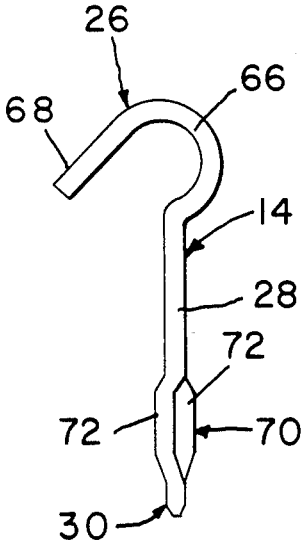
FIG. 3 is a end view of a stamped and formed contact element.

As shown in FIG. 3, ferrule 26 is formed into a channel portion 66 and end portion 68.

The width and thickness of plate 28 is the same as ferrule 26 to provide maximum current carrying capacity to pins 30.

Pre-formed pins 30' are formed to include compliant section 70 by pushing the sides along shear plane 64 to form spring legs 72. Compliant section 70 is fully disclosed in U.S. Pat. No. 4,186,982 which is incorporated herein by reference.

As shown in FIG. 2, there are five pins 30'. Stations (not shown) could be included in the stamping line (not shown) to selectively stamp blanks 64 with fewer than five pins 30' so as to form contact elements 14*b* and 14*c* as shown in FIG. 1. This and similar alternatives however are costly and more importantly, reduce flexibility in the use thereof. By providing five pins 30, the user can simply nip off those pins 30 not required and accordingly does not have to have several different varieties on hand.

Figure 4:
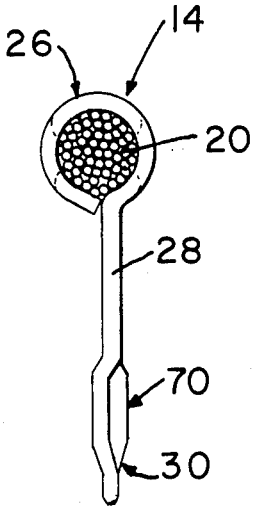
FIGS. 4 and 5 are end and cross-sectional views showing the contact element on and being crimped to the wire of the power bus system.
Figure 5:
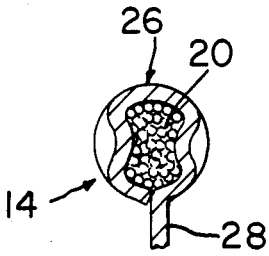

Contact element 14 is supplied to the user in the form shown in FIG. 3. FIGS. 4 and 5 illustrate how wire 12 is terminated to element 14. After stripping insulation 22 at a predetermined location along wire 12, the exposed portion of conductor 20 is placed into channel portion 66 and end portion 68 bent around to engage the upper edge of plate as shown in FIG. 4. Ferrule 26 is then crimped as shown in FIG. 5, using a crimping tool such as one wherein the crimping jaws are accessible on the side of the crimping head (not shown).

Although contact elements 14 may be made with more than five pins 30, five provides the maximum number needed and further provides a large degree of flexibility in tailoring elements 14 to most of the hole patterns encounter on circuit boards 34. Also, pins 30 have been illustrated with compliant section 70 thereon. Here again, utilizing compliant section 70 as a means of engaging circuit board 34 appears to be the best of several methods although the use of other means/e.g., solder leads and feet (not shown) may be used.

Figure 6:
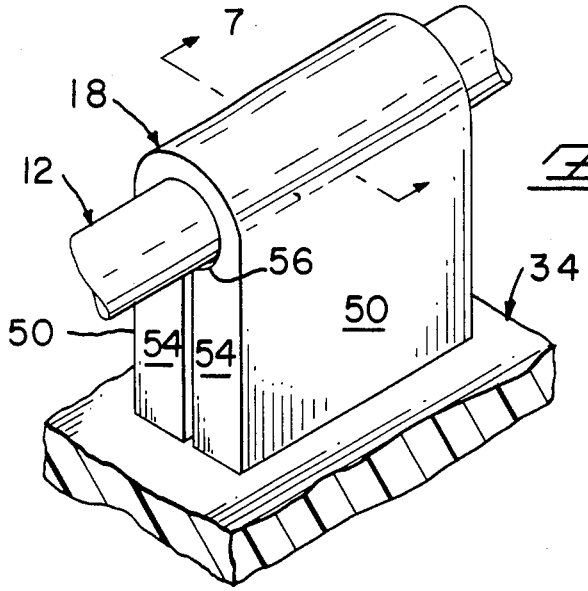
FIG. 6 is a perspective view showing the insulative housing positioned over a contact element mounted on a circuit board.
Figure 7:
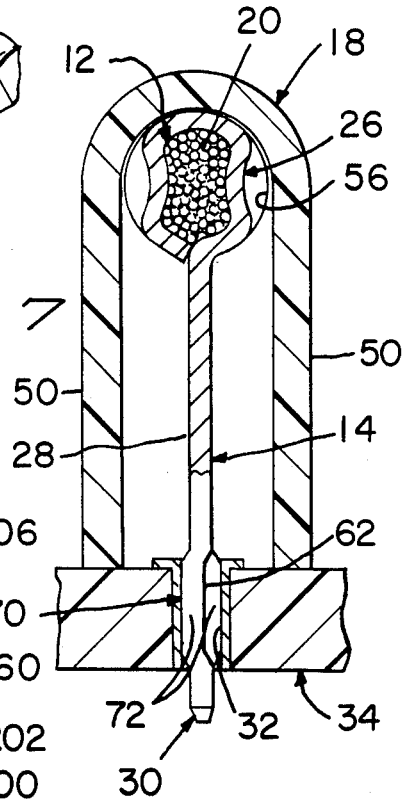
FIG. 7 is a cross-sectional view of the insulated contact element of FIG. 6 taken along line 7—7 thereon.

FIG. 6 and 7 show contact element 14 mounted on circuit board 34 with wire 12 terminated in ferrule 26 and insulative housing 18 positioned thereover to prevent accidental short circuiting and people from coming into contact with the electrical connection.

In mounting contact element 14, spring legs 72 of compliant section 70 of pin 30 are inserted into plated-through hole 32 in board 34. As the legs 72 encounter the wall of hole 32, they are forced towards each other along shear plane 62. The combined resilient compression of legs 72 and the friction as they slide across each other along the shear plane retains pin 30 in hole 32 with a high degree of stability but yet can be removed and used again if required.

After mounting contact element 14 in holes 32, housing 18 is placed thereover. Being resilient, skirt 50 and flaps 54 are spread out to pass over ferrule 26 and close up as wire 12 enters openings 56. Preferably housing 18 is supported on board 34 rather than on wire 12.

FIGS. 8–12 show contact element 114 which is an alternative embodiment of contact element 14.

Figure 8:
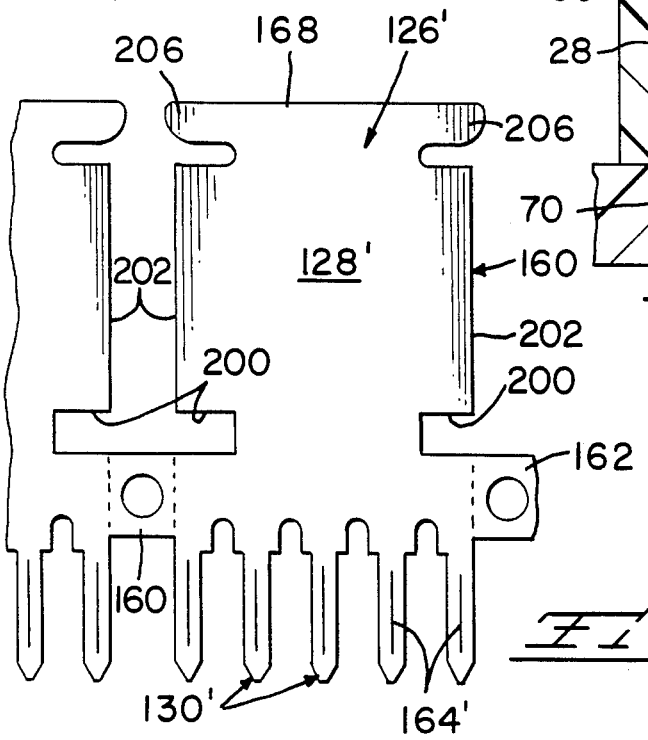
FIG. 8 is a plan view of a stamped but not formed alternative embodiment of the contact element.

As shown in FIG. 8, contact elements 114 are stamped out on a continuous strip which carrier strips 162 connecting preformed blanks 160.

Pins 130 are identical to pins 30 on elements 14, i.e., pins 130 include compliant section 170 with spring legs 172 on each side of shear plane 162.

The blank 160 as shown in FIG. 8 includes preformed pins 130' at one end of plate 128' and, at the opposite end, pre-formed ferrule 126'. Laterally open slots 200 are provided on each side edge 202 of plate 128' and are located near the attachment of carrier strips 162.

Similarly, pre-formed ferrule 126' is slotted on each side edge 202 to provide ears 206.

Figure 9:
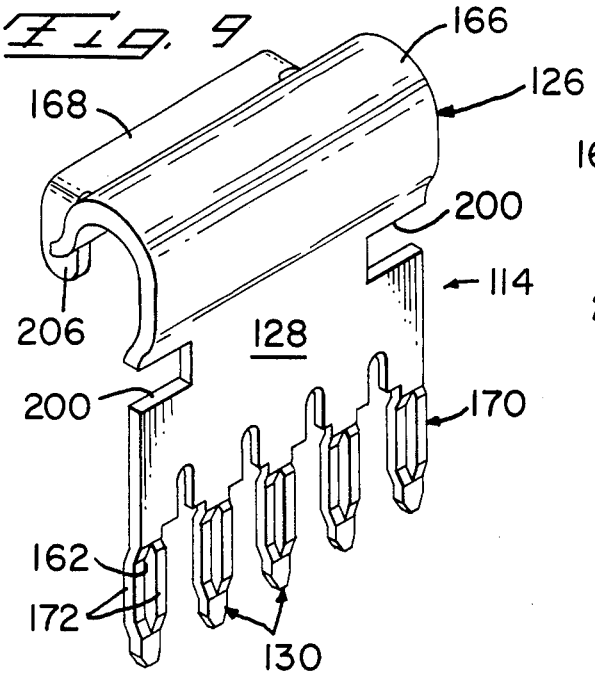
FIGS. 9 and 10 are perspective and end views respectively of the stamped and formed alternative embodiment.
Figure 10:
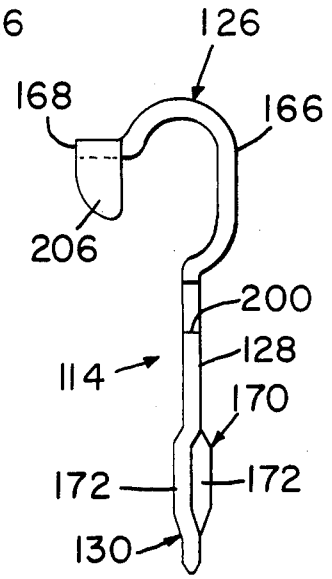

As shown in FIGS. 9 and 10, ferrule 126 is formed into non-symmetrical, channel portion 166 and end portion 168 with ears 206 on end portion 168 bent down at right angles relative thereto. Pins 130 are formed as described above with respect to contact element 14.

Figure 11A:
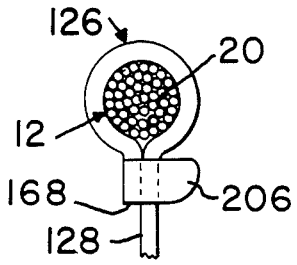
FIGS. 11A and 11B are end views showing the alternative embodiment being terminated to the wire of the power bus system.
Figure 11B:
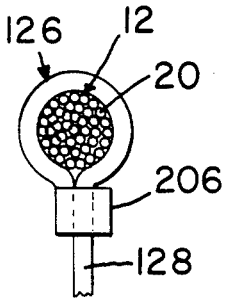

Contact elements 114 are supplied to the user in the form shown in FIGS. 9 and 10. As shown in FIGS. 11A and 11B, wire 12 is terminated to element 114 by removing a section of insulation 22 and placing the exposed section of conductor 20 into channel portion 166. End portion 168 is then brought down and around with ears 206 entering respective slots 200 as shown in FIG. 11A and are then bent against plate 128 to latch end portion 168 to plate 128 as shown in FIG. 11B. Ferrule 126 may then be crimped if desired.

Figure 12:
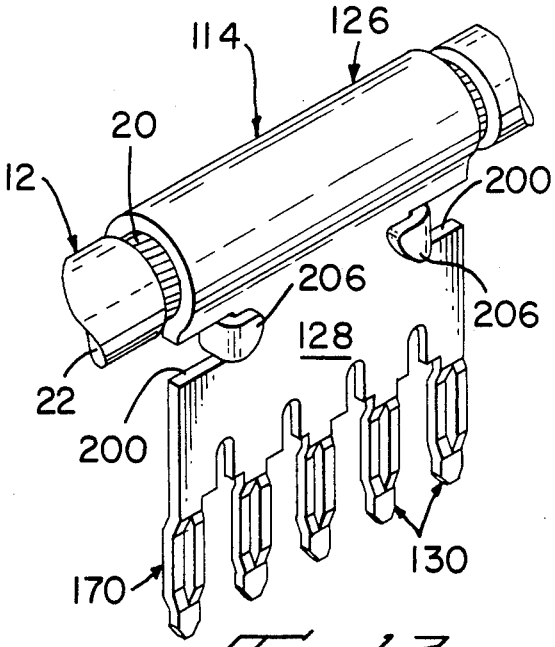
FIG. 12 is a perspective view of the alternative embodiment terminated to the wire.

FIG. 12 shows wire 12 terminated to contact element 114.

Protective housing 18, as described above, may be used with contact element 114.

In use, insulation jacket 22 on electrical wire 12, which is to be connected to an appropriate power source (not shown), is removed from wire 12 at locations corresponding to power entry holes 32 on board 34. Pins 30, 130 on contact elements 14/114 are nipped off if and as required and elements 14/114 are crimiped or secured around the bared conductor 20 sites. Pins 30, 130 are then inserted into holes 32 to mount contact elements 14/114 on the board and to electrically interconnect power traces 36 with wire 12. Protective housing 18 are snapped on over contact elements 14/114 to prevent accidental engagement therewith which may result in short circuiting. The end of wire 12 may be terminated in terminal 16 for electrical connection with the aforementioned power source or for electrical connection to another terminal 16 on another power bus system 10 or otherwise as the particular situation requires.

If for some reason, the power circuits on board 34 requires a modification, contact elements 14/114 are removed from their mounting sites and simply rerouted to new sites. Contact elements 14/114 may be removed from wire 12 if need be without destroying system 10; e.g., by cutting plate 28 where it joins ferrule 26 on elements 14 or releasing ears 206 on contact elements 114.

As can be discerned, a flexible power bus system for printed circuit boards has been disclosed which includes a electrical wire with one or more electrical contact elements terminated thereto for electrical engagement with power traces on the circuit board. The contact elements include a wire engaging ferrule at one end of a plate and pins at another end for insertion into plated through holes in the circuit board. The ferrule includes a channel portion into which the wire conductor is inserted and end portion which is wrapped around to confine the conductor in the channel portion. Crimping the ferrule around the conductor completes the termination. An insulative housing for use with the contact elements is also disclosed. The housing includes parallel skirts attached to each side of a bright, flaps to close the ends and an opening therethrough for the wire.

An alternative contact element is also disclosed which secures the conductor in the ferrule by ears on the end portion which are wrapped around the edges of slots in the plate.

I claim:

1. A power bus system for use with a flexible electrical wire in distributing power on a printed circuit board, said system comprising:

one or more electrical contact means for being positioned at one or more locations on a circuit board and being electrically connected to a flexible electrical wire intermediate the ends thereof, each of said electrical contact means having plate means with one edge being formed back around towards said plate means to provide an open wire receiving means adapted to be closed and crimped around said electrical wire and further having a plurality of space apart pin means extending outwardly from an opposite edge of said plate means, said pin means being adapted to be electrically engage conductive means on said circuit board; and one or more protective dielectric housing means for removably covering each of said one or more electrical contact means, said housing means having bight means for being received over said wire receiving means and skirt means hingedly mounted on and extending from each side edge of said bight means, said skirt means being adapted to be resiliently flexed laterally outwardly relative to said bight means to permit positioning said bight means over said wire receiving means and then to return to the original position relative to said bight means to shield said plate means.

2. The power bus system of claim 1 further including flap means attached to and extending inwardly from each end edge of each of said skirt means for closing the ends of said housing means.

* * * * *